US006547193B2

(12) United States Patent
Money et al.

(10) Patent No.: US 6,547,193 B2
(45) Date of Patent: Apr. 15, 2003

(54) MULTI-DIRECTIONAL FOREARM AND WRIST SUPPORT FOR USERS OF DATA INPUT DEVICES

(75) Inventors: Steven J. Money, 202 Pleasant St., Rehoboth, MA (US) 02769; Peter M. Nielsen, Quincy, MA (US)

(73) Assignee: Steven J. Money

( * ) Notice: Subject to any disclaimer, the term of this patent is extended or adjusted under 35 U.S.C. 154(b) by 0 days.

(21) Appl. No.: 09/802,832

(22) Filed: Mar. 9, 2001

(65) Prior Publication Data

US 2002/0125379 A1 Sep. 12, 2002

(51) Int. Cl.[7] ..... B68G 5/00; B43L 15/00

(52) U.S. Cl. ..... 248/118; 248/346.01; 248/918; 248/118.1; D24/211

(58) Field of Search ..... 248/118, 118.1, 248/346.01, 918; D24/211

(56) References Cited

U.S. PATENT DOCUMENTS 3,415,514 A * 12/1968 Weihs ..... 482/79
D226,875 S * 5/1973 Haworth, Jr. et al. ..... D24/211
4,169,466 A 10/1979 Wong
D263,623 S * 3/1982 Conn, Sr. ..... D24/211
5,005,560 A * 4/1991 Quam et al. ..... 128/57
5,050,826 A 9/1991 Johnston
5,263,474 A 11/1993 Agader
5,386,956 A 2/1995 Hatcher
5,467,950 A * 11/1995 Dumitru ..... 248/118.1
5,467,952 A * 11/1995 Martin ..... 248/118.1
5,478,034 A * 12/1995 Cunningham et al. ... 248/118.5
D374,082 S * 9/1996 Vitko ..... D24/211
D404,139 S * 1/1999 Young ..... D24/212
5,971,331 A * 10/1999 Getsay ..... 248/118
6,056,247 A * 5/2000 Hoglund ..... 248/118.1
6,135,399 A * 10/2000 Savoie et al. ..... 248/118

* cited by examiner

*Primary Examiner*—Anita King
(74) *Attorney, Agent, or Firm*—Pandiscio & Pandiscio

(57) ABSTRACT

A wrist or forearm support for a person operating a computer input device such as a computer mouse comprising a plurality of balls and a housing for captivating the balls so that they are capable of multi-directional rotational movement. The balls protrude through an opening in the housing in position to be engaged by and support a wrist or forearm that extends over said housing, thereby facilitating multi-directional motion of the supported wrist or forearm.

18 Claims, 6 Drawing Sheets

MULTI-DIRECTIONAL FOREARM AND WRIST SUPPORT FOR USERS OF DATA INPUT DEVICES

BACKGROUND

1. Field of the Invention

The invention relates to Forearm and Wrist Supports and Rests for use with computer input devices, such as keyboards, "mice", trackballs, graphics tablets, game controllers, joysticks, touch pads, and the like, and more particularly to such supports and devices designed to delay and/or prevent certain Repetitive Motion Disorders (RMD), Carpal Tunnel Syndrome, and general musculoskeletal fatigue.

2. Description Of Prior Art

It is recognized that extensive use of a manual computer input device such as a mouse, keyboard, etc. is fatiguing and stressful and in time can result in physical injury to the user's wrist or forearm. It also is known that use of such input devices tends to produce general musculoskeletal fatigue which in turn can effect chronic injuries to areas of the body beyond those directly related to operation of the input devices, such as upper arm, shoulder, neck, and upper, and lower back injuries.

The existing medical and ergonometric literature and currently available remedies do not address the kinesiology of motion in the operation of computer input devices that apply musculoskeletal forces in multiple directions and often with the result of opposing physiological forces. Lifting the wrist, for example, causes contraction on the top of the wrist and elongation on the underside. The repetitive compound motions of the hand and wrist of a user of a computer input device causes musculoskeletal tensions. In the case of operating a computer mouse, for example, the index finger and associated muscles and tendons are holding the mouse button, while at the same time the hand, thumb, and other fingers are holding and causing the mouse to move. This latter motion also impacts the wrist and forearm that must twist on its axis to maintain pressure on the mouse and complete the desired action.

Common preventive measures and recommendations for minimizing or preventing RMD injuries, and/or for providing relief or care of such disorders, are frequent breaks during the work day, changes in body position, frequent massaging of body parts, and specific exercise before returning to work with input devices.

A number of patented wrist or arm supports are known which address the problems of RMD, Carpal Tunnel Syndrome, and general musculoskeletal fatigue. Such supports have either provided a static surface upon which the user is able to support the wrist or forearm while typing or operating a mouse or another type of input device, or have provided a static support functionality while also providing for motion in a linear fashion across the support by the use of one or more rollers or beads mounted for single-direction, i.e., single axis, rotation. Wrist or forearm rests that provide a static support surface tend to reduce the extent of musculoskeletal stress and fatigue resulting from holding the hand, wrist, and forearm aloft while entering data or operating an input device. Those support devices comprising rollers or beads mounted for rotation on a single axis are somewhat better at reducing stress and fatigue with respect to movement of the user's hand and arm forward and backward over a keyboard or in the operation of a computer mouse or other input device.

U.S. Pat. No. 5,971,331 issued Jun. 19, 1997 to James G. Getsay, discloses a stationary device for supporting a wrist or hand of a person during use of a computer keyboard and mouse which utilizes angularly positioned rollers for providing maximum contact points and comfort for support of the user's wrist and/or hand. U.S. Pat. No. 5,467,950, issued Feb. 9, 1993 to D. Dumitru, discloses a stationary forearm/wrist support that includes a plurality of beads rotatable about a fixed rod. U.S. Pat. No. 5,050,826, issued Sep. 24, 1991 to K. M. Johnston, shows a stationary hand/wrist support comprising padded rollers mounted adjacent to a keyboard. A similar arrangement is disclosed by U.S. Pat. No. 5,478,034, issued Dec. 26, 1995 to E. E. Cunningham et al. U.S. Pat. No. 5,386,956, issued Feb. 7, 1995 to D. M. Hatcher, shows a stationary wrist support device for persons using a keyboard that is tiltable to adjust the support angle.

The devices disclosed in the foregoing patents, which are representative of what has been available prior to this invention, have a common limitation—although they provide wrist or forearm support, they facilitate freedom of motion in a single direction. In the conception of this invention, it has been recognized that a satisfactory device should not only support the hand, wrist, and/or forearm of a person using a computer input device of the type described, but in addition the supporting means should be capable of motion in multiple directions so as to allow a compound range of motions of the supported hand, wrist or forearm with negligible negative force applied against the motions.

OBJECTS AND ADVANTAGES

Accordingly the primary object of this invention is provide a support device for users of computer input devices, or other input devices involving intensive hand and wrist motion activity, that comprises supporting means capable of multi-directional rotation so as to provide support through a compound range of hand/wrist motions, with little or no negative force to prevent or substantially impede such motions.

Another object of the invention is to provide a novel support for an operator's hand, wrist and/or forearm that a provides a massaging action as the supported member undergoes motion in various directions.

A further object is to provide a multi-directional hand, wrist, and/or forearm support for computer operators and the like which can be easily and economically manufactured using a variety of materials.

Another object is to provide an ergonomically designed device for supporting the hand, wrist, and/or forearm that provides a supporting and massaging action for the supported appendage continuously through a compound range of motions.

Still another object is to provide an appendage support that can be made in different sizes according to the input device with which it is intended to be used.

Another more specific object is to provide a device that facilitates multi-directional movement of a supported hand, wrist, or forearm of a person, thereby aiding the person to reach and operate a keyboard, computer mouse, trackball, game controller or other hand operated input device.

These and other objects are achieved by providing a device that comprises a plurality of spherical balls, and a housing or cage having means for rotatably captivating the spherical balls in side-by-side relation and in position to function as a support for a wrist or forearm that extends over the device, the spherical balls being rotatable in response to movement of the supported wrist or forearm so as to facilitate multi-directional motion of the supported appendage. Each ball is captivated against vertical movement relative to the housing and also is in contact with neighboring balls or a neighboring ball and a side wall of the housing or cage. In the preferred embodiment of the invention, each ball makes a three-point contact with the housing or cage in a vertical plane, thereby minimizing resistance to rotation induced by the weight of the supported appendage on the balls. As the user's wrist or forearm twists and moves back and forth in the action of clicking and moving a computer mouse, for example, the spherical balls (a) support the wrist or forearm and (b) simultaneously rotate under the influence of the supported wrist or forearm as the latter undergoes multi-directional movement over the device. In addition to their support function, the spherical balls serve as a musculoskeletal massaging tool to help reduce stress and fatigue.

Other features and advantages of the invention are disclosed or rendered obvious by the following detailed description and the accompanying drawings.

THE DRAWINGS

In the several figures, like elements are identified by like numerals.

DETAILED DESCRIPTION OF THE INVENTION

Figure 1:
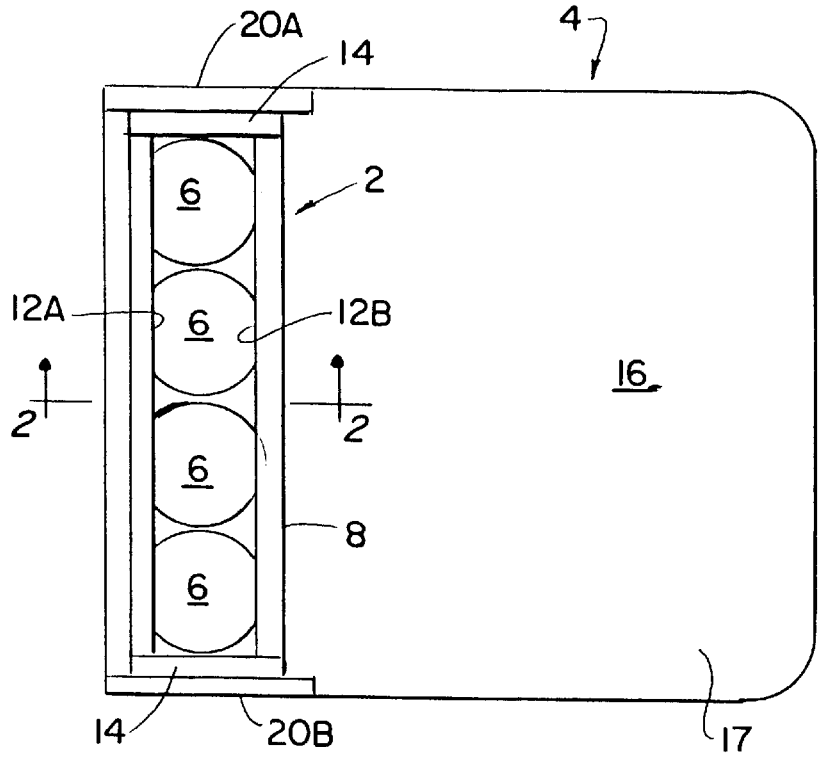
FIG. 1 is a fragmentary plan view of a first embodiment of the invention designed as a wrist rest for use with a computer mouse.
Figure 2:
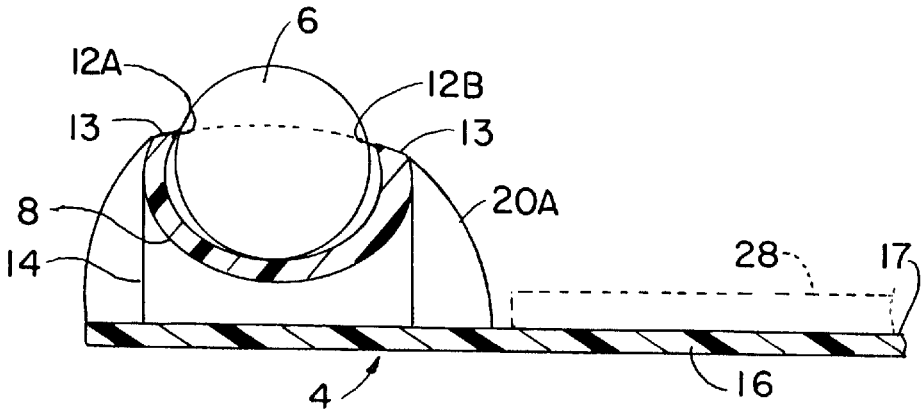
FIG. 2 is a cross-sectional view taken along line 2—2 of FIG. 1.

Referring first to FIGS. 1 and 2, the illustrated wrist rest comprises a ball unit 2 attached to a base member 4 which supports the ball unit and also functions as, or carries, a mouse pad. The ball unit comprises a plurality of spherical balls 6 and a housing or enclosure comprising a channel member 8 and end walls 14 that close off the opposite ends of channel member 8. The balls may be solid, or hollow shells filled with a liquid, particulate or solid material, or even hollow as long as they are capable of supporting a wrist or forearm without collapsing or becoming distorted to the point where they are no longer round. As shown in FIG. 2, channel member 8 is formed with a generally elliptical cross-sectional configuration and has an open top side characterized by parallel mutually spaced and confronting edges 12A and 12B. The parallel edges 12A and 12B of the channel member are spaced apart from one another, with the gap between them being somewhat less than the diameter of balls 6, whereby to prevent the balls from passing between those edges.

As viewed in FIG. 2, the edges 12A and 12B of channel member 8 are located at approximately the 10 o'clock and 2 o'clock positions respectively. Member 8 also is shaped so that the minor axis of the ellipse forming the basis of its elliptical cross-sectional shape is shorter than the diameter of the spherical balls 6, while the major axis of that ellipse is longer than the ball diameter (note: in FIG. 2 the horizontal center diameter of the inner surface of channel member 8 corresponds to the major axis of the ellipse, while the vertical center diameter corresponds to the minor axis of the ellipse). As a consequence the spherical balls make a three-point contact with channel member 8—at the six o'clock position and at substantially the ten and two o'clock positions. This three-point contact causes the spherical balls to be captivated so that they cannot pass vertically between the edges 12A and 12B yet are capable of rotating inside of channel member 8. The end walls 14 prevent movement of the balls out of the ends of channel member 8. Preferably channel member 8 has beveled surfaces 13 at its edges 12A and 12*b* in order to minimize resistance to wrist or forearm movement or irritation to the user's wrist or forearm.

The base member 4 is in the form of a flat sheet 16. Preferably, but not necessarily, sheet 16 has a rectangular shape. Attached to the base member adjacent opposite side edges thereof are two separately formed parallel support members 20A and 20B that extend perpendicular to the plane of sheet 16. The ball unit 2 is disposed between, and its end walls 14 affixed to, support members 20A and 20B. In this connection, it should be appreciated that end walls 14 may be omitted, in which event the opposite ends of channel member 8 may be secured directly to end supports 20A and 20B.

In the wrist/forearm rest structure described above, each ball 6 makes contact at a maximum of five points. With the exception of the two balls located at the opposite ends of the row of balls, each ball contacts the supporting channel member at three points and also may contact each adjacent ball. The two end balls make contact with only one ball but may also engage the side walls 14 or the side supports. Hence all of the balls make contact with other balls and the supporting structure at a maximum of five points.

Figure 3:
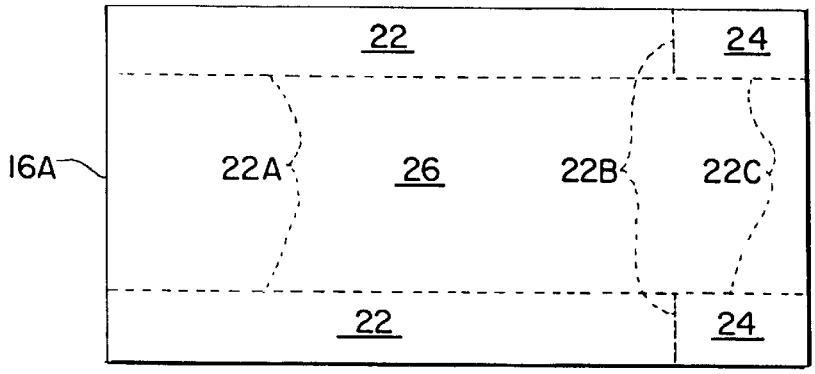
FIG. 3 is a plan view of a plastic sheet for use in forming an alternative form of base member.

FIG. 3 illustrates an alternative way to provide a base member with end supports for the ball unit. In this case, a flat rectangular sheet 16A of suitable material is provided. A section 22, demarcated by two pairs of dotted lines 22A and 22B, is cut away at each of the opposite sides of the sheet, so that the remaining portion of the sheet is shaped with oppositely extending sections 24. Each of the latter sections is subsequently bent along dotted lines 22C so as to extend at a right angle to the plane of sheet 16A, so as to form a base member having a main portion 26 and parallel spaced rectangular end supports formed by the end sections 24. With a base member formed as described from sheet 16A, a ball unit like that shown in FIGS. 1 and 2, or modified by one of channel members 8A or 8B (FIGS. 4 and 5), may be positioned between and secured to end supports 24 in the same manner as previously described in connection with end supports 20A, 20B of the embodiment of FIGS. 1 and 2 (20A, B). As noted above, end walls 14 may be omitted from the ball unit 2, in which case the channel member 8 is secured directly to end supports 24.

Member 8, end walls 14, end supports 20A, 20B, and sheets 16 and 16A may be made of various materials, including but not limited to a synthetic plastic material, wood, or a metal such as aluminum. Depending on the composition of member 8, end walls 14, sheets 16, 16A, and end supports 20A, 20B and 24, the ball unit may be secured to the side supports by cementing, brazing, soldering, welding or mechanical means, e.g., mechanical interlocking. Preferably ball unit member 8, end walls 14, (and also members 8A and 8B shown in FIGS. 4 and 5), end supports 20A, 20B, and sheets 16 and 16A are made of a plastic material, and end walls 14 (or the opposite ends of channel member 8 if end walls 14 are omitted) are secured to end supports 20A, 20B or 24 by means of a suitable cement or by ultrasonic welding or other suitable means. Preferably they are all made of a thermoplastic material that can be extruded or injection molded.

Referring again to FIGS. 1 and 2, it is contemplated and preferred that the exposed upper surface 17 of the base member that extends away from the ball unit be formed, or the sheets 16 and 16A have a composition, such that the exposed upper surface is capable of providing traction for the ball of a computer mouse. Thus, for example, the exposed upper surface of base member 4 or 4A (FIG. 6) that extends forwardly of the ball unit may be pebbled or roughened just enough to provide traction but not so much as to impede mouse movement thereon. As an alternative, a separate conventional mouse pad (represented in phantom at 28 in FIG. 2) may be adhesively applied to the exposed upper surface 17 of base member 4 and the corresponding base member formed from sheet 16A (FIG. 3). By way of example but not limitation, the mouse pad 28 may be made of a dense plastic foam or a rubber compound.

Figure 4:
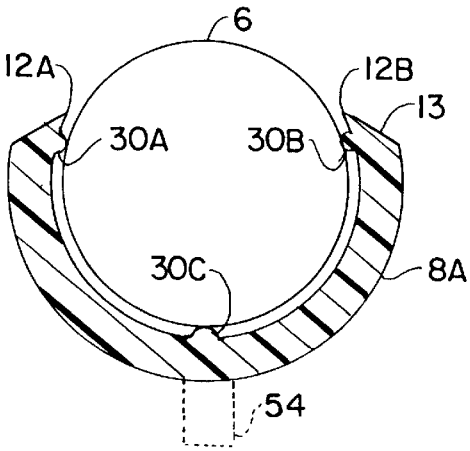
FIG. 4 is a cross-sectional view of a modified form of sphere-captivating channel member for use with the first or second embodiments of the invention.

FIG. 4 illustrates a modified form of sphere-captivating channel member 8A that may be substituted for channel member 8 in constructing a wrist or forearm rest as described herein. In this case the channel member 8A has a circular cross-sectional configuration and its otherwise smooth inner surface is interrupted by three mutually spaced ribs (ridges) 30A, 30B and 30C that extend lengthwise of the channel member for providing 3-point contact with the balls. Preferably rib 30C is located at the six o'clock position, while ribs 30A and 30B are located at approximately the 10 o'clock and 2 o'clock positions as viewed in FIG. 4 so as to assure that the balls cannot be lifted out of the channel member while maximizing exposure of the balls to a user's wrist or forearm. The three ribs 30 provide 3-point contact with the balls, thereby minimizing resistance to rotation of the balls in the tubular member. Alternatively, each rib 30 may be replaced by rows of aligned mutually spaced rounded protuberances.

Figure 5:
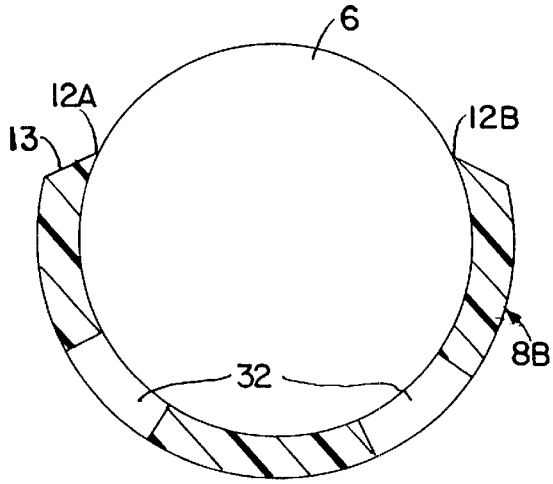
FIG. 5 is a cross-sectional view of another form of channel member that may be used in practicing the invention.

As a further alternative illustrated in FIG. 5, the ball unit may comprise a channel member 8B having a smooth inner surface that is interrupted by longitudinally-extending holes 32 for the purpose of reducing the amount of surface area that is engaged by the balls, with a consequent limit on the amount of frictional resistance to rotation exerted on the balls by the tubular member. Preferably the holes 32 extend for most of the length of the channel member. Preferably, two holes are provided which are located at approximately the 5 and 7 o'clock positions as shown, so as to produce a three-point contact relationship between each ball 6 and the channel member. Alternatively, a single longitudinally extending ;hole 32 may be provided, preferably located at the 6 o'clock position (not shown). As a further alternative, the channel member may be provided with three or more parallel longitudinally extending holes, in which case each ball will contact the channel member at more than three places. The parallel edges 12A and 12B of the channel member are spaced apart from one another, with the gap between them being somewhat less than the diameter of balls 6, whereby to prevent the balls from passing between those edges.

It is preferred, but not necessary, that the channel members 8, 8A and 8B be made of a suitable plastic, preferably a thermoplastic polymer such as polyethylene, polypropylene or an acrylic polymer. In such case, the tubular members 8, 8A and 8B may be formed by extrusion. Preferably, however, they are formed by molding a sheet plastic into the desired form, with the ribs 30 or other protuberances being created by the molding process. In the case of a channel member 8B or the like, the longitudinally-extending holes may be formed by a stamping operation conducted before the sheet plastic is molded into the channel member shape.

Figure 6:
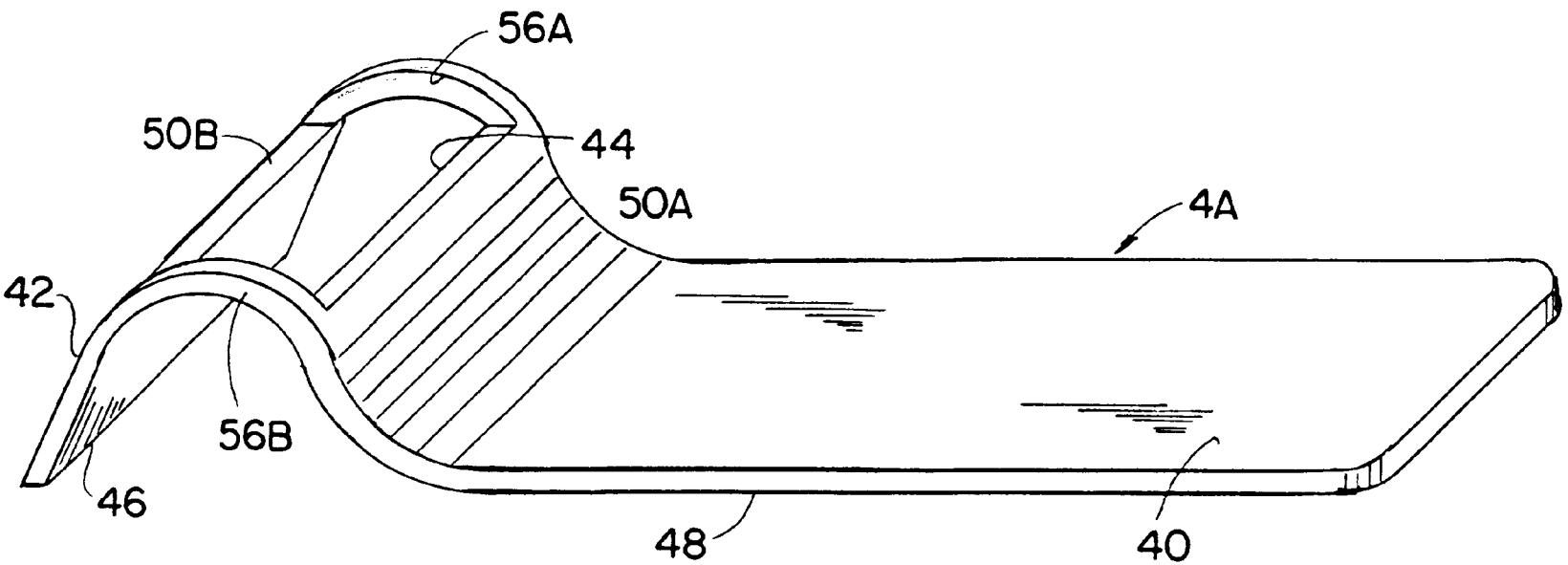
FIG. 6 is a perspective view of a base member of that is used with one of the ball-retaining tube and ball assemblies shown in FIGS. 1–5 to form a preferred embodiment of the invention.
Figure 7:
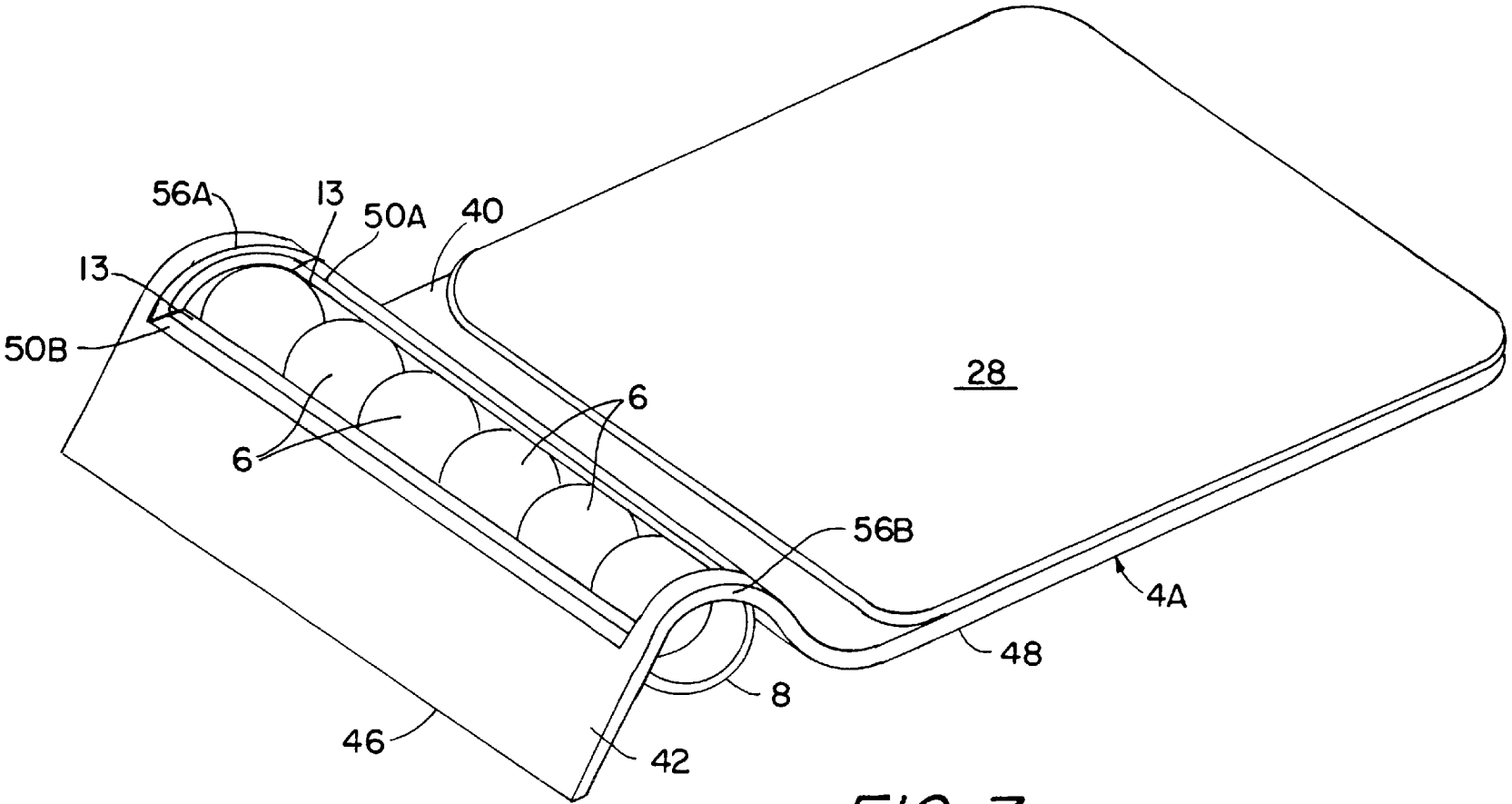
FIG. 7 is a perspective view of a preferred form of wrist or forearm support that bodies the base member of FIG. 6.

FIGS. 6 and 7 combine to illustrate a preferred form of wrist rest provided by the invention for use with a computer mouse. In this case, a sheet of a suitable plastic, wood or metal material is formed into a base member 4A that comprises a flat mouse-supporting portion 40 and a curved upstanding portion 42 that is characterized by a transversely extending straight-sided hole or aperture 44 at its apex. The free edge 46 at the curved end of the base member extends down far enough to reside in the plane of the bottom surface 48 of the mouse-supporting portion 40, with the result that it will engage and be supported by any desk or other platform on which the wrist rest is placed for use. Preferably the long side edge surfaces 50A and 50B of the aperture 44 may be beveled at opposite acute angles to the plane of portion 40, so as to eliminate any sharp corners that could abrade or irritate the user's wrist or forearm or impede wrist or forearm movement over the wrist rest. A separate mouse pad 28 may be attached to the upper surface of base member 4A as shown.

Attached to the underside of the curved upstanding portion of base member 4A is a ball unit which may be like the ball unit 2 shown in FIGS. 1 and 2, or the ball unit shown in FIGS. 4 and 5, or some variation of those units. Preferably, however, the ball unit comprises only the balls 6 and a channel member 8, e.g., a channel member as shown at 8, 8A, 8B or 8C (FIG. 9), with the opposite ends of the channel being open as shown in FIG. 7. As illustrated in FIG. 7, the width of aperture 44, i.e., the gap between its edge surfaces 50A and 50B, may be sized so that the beveled surfaces 13 of the channel member overlap and protrude beyond the edges of edge surfaces 50A and 50B. Alternatively the width of aperture 44 may be sized so that the beveled surfaces 13 are fully concealed by the adjacent sections of curved portion 42. In either case, the effective width of the aperture, i.e., the distance between the edge surfaces 50A and 50B, or the distance between the two beveled edges 13 of the channel member if they protrude beyond the edges 50A and 50B, is less than the diameter of the balls, so as to assure that the balls are retained in channel member 8. At the same time, the two end balls make contact with and are rotatively restrained by the two curved arm portions 56A and 56B that define the ends of aperture 44. As a consequence, in addition to making a three point contact with the channel member 8, each of the end balls makes contact with an adjacent ball and one of the arm portions 56A or 56B; at the same time, each ball located between the two end balls makes the same three point contact with the channel member and also contacts the two balls on either side of it. The channel member 8 and the two curved arm portions cooperate to form a housing for the balls.

Figure 8:
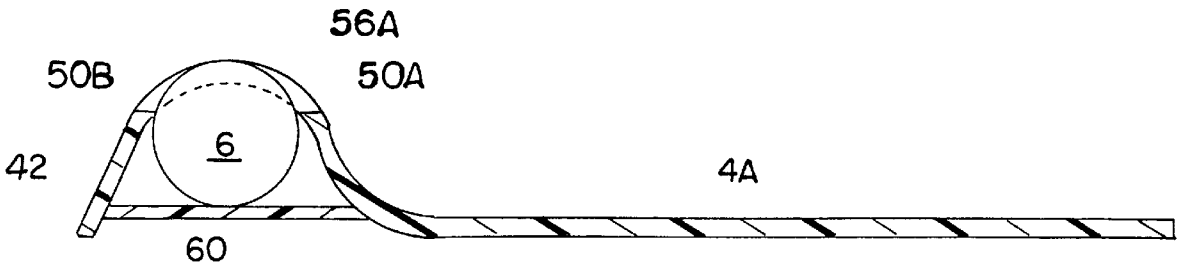
FIG. 8 is a longitudinal sectional view of a modification of the preferred embodiment of the invention.
Figure 9:
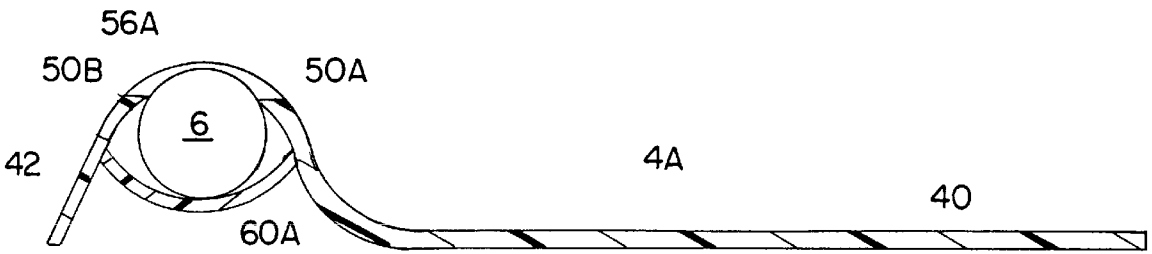
FIG. 9 is a longitudinal sectional view of another modification of the preferred embodiment of the invention.

FIGS. 8 and 9 illustrate modifications of the embodiment shown in FIGS. 6 and 7. In FIG. 8, the base member 4A is unchanged but the curved channel member 8 of FIG. 7 is replaced by a flat floor member 60. The latter is attached to the underside of the curved upstanding portion 42 of the base member. The angle between the front and back sections of curved portion 42 is such that each ball 6 makes a point contact with supporting floor member 60 and point contact with the inner edges of edge surfaces 50A and 50B of aperture 44, so that frictional contact of the balls with floor 60 and base member 4A is minimized. The two end balls supported by floor 60 also make contact with the two curved arm portions 56A and 56B that define the ends of aperture 44. As with the embodiment of FIG. 7, the balls 6 protrude through the aperture 44 in position to be engaged by and support the wrist or forearm of a user, with the aperture 44 being sized to captivate the balls. As with the embodiment of FIGS. 6 and 7, each ball may make contact with one or two other balls and the supporting structure at a maximum of five points, thereby minimizing the resistance to ball rotation.

In FIG. 9, a curved floor member 60A is employed to rotatably support the balls 6. Preferably floor member 60A is of circular curvature in cross-section, but differs from the channel members described above in that it extends through an angle of 180° or less in cross-section and acts simply as a cradle for the balls 6. Accordingly the aperture 44 is sized so that the gap between the inner edges of its edge surfaces 50A and 50B is somewhat less than the diameter of the balls, so that the balls are retained on floor member 60A by virtue of having a diameter greater than the distance between the opposite long edges of aperture 44. The curved portion 42 and the floor member 60A are shaped and sized so that the balls will protrude through aperture 44. The floor member 60A is attached to base member 4A by cement or other suitable means or method. In this case it is preferred that the beveled edge surfaces 13 (FIG. 2) of the floor member be angled so as to make flat contact with the underside of base member 4A adjacent its aperture 44. As with the embodiment of FIG. 8, the two end balls are restrained by the two curved arm portions 56A and 56B of base member 4A that define the ends of aperture 44.

With respect to the embodiments wherein the channel members have end walls 14 or are attached to end supports as shown at 20 and 24, the components are sized and spaced so that the total length of the channel between end walls 14, or between the side supports if end walls 14 are omitted, is slightly larger than the diameter of the balls multiplied by the number of balls, so as to allow for some play between the balls. Also, the diameter of the balls is selected so as to allow a desired clearance between each ball and the supporting portion of the floor or channel member. Preferably, a radial clearance in the range of approximately 0.001" to approximately 0.003" is provided between each ball and adjacent balls or supporting channel structure, e.g., ribs 30A, 30B and 30C. The "play" allowed by such clearance assures rotational freedom for the balls 6. Although the wrist rests may be modified so that each ball contacts the supporting structure and adjacent balls at more than five points, such modification is not favored over the embodiments shown in the drawings.

Figure 10:
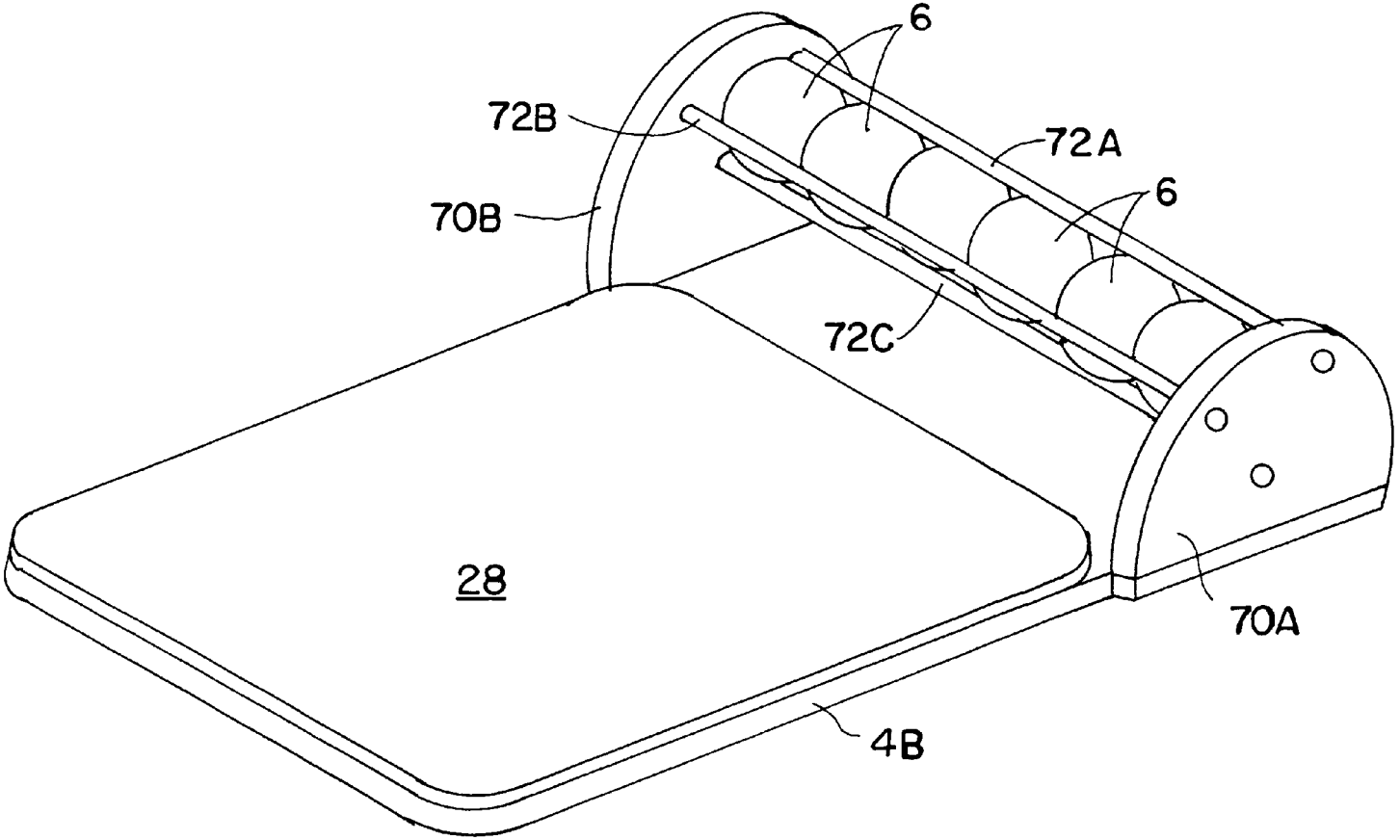
FIG. 10 illustrates a further embodiment of the invention.

FIG. 10 illustrates a further embodiment of the invention. In this case a pair of vertically extending end support plates 70A and 70B are attached to opposite side edges of a flat base member 4B. Attached to and extending between those end support plates are three shafts 72A, 72B and 72C. The latter may be made in a number of different cross-sectional shapes, but preferably they are circular in cross-section. Shafts 72 may be solid rods or hollow tubes. Shafts 72 are located in a triangular relationship with one another, with shaft 72C being located at the 6 o'clock position and shafts 72A and 72C being located at approximately the 2 o'clock and 10 o'clock positions respectively. The three shafts form a cage for captivating a plurality of balls 6. The latter are sized to make a close but rotatable fit within the bars. Alternatively, the upper surface of base member 4B may be formed so as to function as a mouse pad.

As is evident from the foregoing description, the ball captivating and supporting designs disclosed herein are favored and advantageous in that the captivated balls are free to undergo multi-directional rotation substantially Independently of one another. That three-point vertical plane contact and ease of rotation of the balls is achieved economically by using molded or formed members and conventional manufacturing and attaching methods.

In contrast to conventional static wrist or forearm supports which offer substantial resistance to fore and aft and sidewise movement of the supported appendage, the wrist or forearm supports of this invention offer the advantage that the curvature and multi-directional rotatability of the spherical balls allows the supported wrist or forearm of the user to stay in contact with the balls as the wrist or forearm undergoes movement, with the balls rotating under the influence of the forces applied to them by the supported wrist or forearm. Additionally the balls provide a natural massaging action on a supported appendage as the latter undergoes compound motions relative to the wrist or forearm support in the act of operating an input device such as a computer mouse, game controller, keyboard and the like.

The width of the arm/wrist rest, including the number of captivated balls, may vary. Although the preferred embodiment of the invention is a wrist or forearm support for a person using a computer mouse, track ball, game controller, joy stick and the like, it is to be appreciated that the invention also may take the form of a wrist or forearm support for a keyboard, digitizing pad, or other device. In such event, for example, the flat front extension 40 of base member 4A (FIG. 7) is changed or omitted and the side to side dimension of the support is increased sufficiently to provide a support for both wrists or forearms of the operator, preferably to approximately the width of a standard computer keyboard or other device with which it is to be used, with the number of balls 6 and the length of the aperture 44 and the length of ribs 30 or holes 32 (if present) being increased commensurate with the overall width of the support. A stand-alone conventional computer keyboard typically measures approximately 18 inches in width. Accordingly, for example, a wrist or forearm rest for a keyboard operator may be provided by modifying the ball unit 2 shown in FIGS. 1 and 2 so that it has a width (e.g., the overall distance between end walls 14) of approximately 18 inches, and using it with or without base member 4. It should be understood also that in the various embodiments described herein, the extent to which the balls are exposed for engagement by a user's wrist or forearm may be adjusted. For example, the embodiment of FIG. 7 could be designed so the balls (1) are level with, or (2) project above or (3) are below the apex of the curved arm portions 56A and 56B.

The invention is capable of various other modifications. Thus, for example, the channel member may be formed with a depending web section (as shown in phantom at 54 in FIG. 4) that depends long enough to engage the desk or other platform on which the wrist rest or ball unit is located, whereby to provide vertical support for the ball-retaining channel member when it is subjected to the downward pressure exerted by the wrist or forearm of a user. Also the base member 4 may be extended to affix the wrist/forearm support to an input device and/or tilted to position the input device or the wrist/forearm support for optimal benefit to the operator. Still another contemplated modification is to provide two or more parallel rows of balls instead of a single row as shown in the drawings.

An advantage of the invention is that it has multi-purpose functionality. For example, the exposed upper surface of the forward extension 40 of the base member 4A may carry advertising or may serve as a packaging support for such items as software CD ROM's, music CD's, DVD's, business cards, or preprinted advertising brochure. Also the balls may be made with the same or different colors and/or imprinted with a corporate logo or trademark or other words or symbols.

It is appreciated that various other modifications and changes and other uses and applications of the present invention may be obvious to persons skilled in the art after considering the foregoing description and the accompanying drawings. Therefore, it is intended that all matter contained in the foregoing description or shown in the accompanying drawings shall be interpreted in an illustrative and not in a limiting sense.

What is claimed is:

1. A wrist or forearm support comprising a housing and a plurality of spherical balls, said housing comprising mechanical means defining a channel in which said balls are captivated in side-by-side relation, said channel having an opening that extends lengthwise of said channel with said balls protruding through said opening in position to be engaged by and support a wrist or forearm that extends over said housing, each of said spherical balls being free to contact adjacent balls and being rotatable multi-directionally in said channel in response to movement of the supported wrist or forearm so as to facilitate multi-directional motion of said supported wrist or forearm, said housing comprising a sheet of plastic that has been molded so as to form a curved portion that defines at least part of said channel, and said opening being formed in said curved portion.

2. A wrist or forearm support according to claim 1 wherein said sheet of plastic also comprises a flat portion that extends away from said channel and has an upper surface adapted for use with a computer mouse.

3. A wrist or forearm support comprising a housing and a plurality of spherical balls rotatably supported by said housing, said housing comprising a rectangular sheet of plastic having top and bottom surfaces, oppositely disposed first and second opposite side edges and oppositely disposed third and fourth side edges, said sheet being molded so as to form a curved portion that is curved between said third and fourth side edges and extends from one to the other of said first and second side edges, said curved portion having an elongate opening that extends lengthwise between said first and second side edges, said balls protruding through said opening, and support means attached to said bottom surface of said sheet of plastic for supporting said balls so that said balls are rotatably captivated by and make a three point contact with said sheet and said support means, said balls being rotatably captivated by said sheet and said support means in side-by-side relation and in position to function as a support for a wrist or forearm that extends over said housing, said balls being rotatable multi-directionally in response to a supported wrist or forearm, so as to facilitate multi-directional movement of said supported wrist or forearm.

4. A wrist or forearm support according to claim 3 wherein said support means is a channel member that defines a channel aligned with said opening.

5. A wrist or forearm support according to claim 3 wherein said channel member is characterized by a curved cross-sectional shape that extends through an angle in excess of 180 degrees.

6. A wrist or forearm support according to claim 5 wherein said sheet of plastic also comprises a flat portion that includes said third side edge and extends away from said fourth side edge and said curved portion, said flat portion having an upper surface adapted for use with a computer mouse.

7. A wrist or forearm support comprising a ball housing and a plurality of spherical balls disposed in said ball housing, said ball housing comprising means engaged with the outer surfaces of said balls for rotatably supporting and captivating said balls side-by-side in a straight row with each ball being free to contact each adjacent ball and to rotate multi-directionally relative to said housing and independently of the rest of said balls, said balls protruding from said housing in position to function as a support for a wrist or forearm that extends over the ball housing, whereby rotational movement of one or more of said balls can occur in response to movement of a supported wrist or forearm.

8. A wrist or forearm support according to claim 7 wherein said ball housing is characterized by a curved cross-sectional shape that extends through an angle in excess of 180 degrees.

9. A wrist or forearm support according to claim 7 wherein said means defines a channel having opposite ends and an opening extending lengthwise of said channel and includes end members closing off said opposite ends of said channel, and further wherein said balls are captivated in said channel between said opposite end members and protrude through said opening in position to be engaged by and support a wrist or forearm that extends over said ball housing.

10. A wrist or forearm support according to claim 9 wherein said channel is defined by side and bottom members that provide low friction contact with said balls.

11. A wrist or forearm support according to claim 9 wherein said channel is formed by three parallel and mutually spaced members.

12. A wrist or forearm support according to claim 9 wherein said means comprises a member having projecting portions running lengthwise of said channel, and further wherein said balls are engaged with and supported by said projecting portions.

13. A wrist or forearm support according to claim 12 wherein said projecting portions comprise three mutually spaced and parallel ridges.

14. A wrist or forearm support according to claim 7 wherein said means comprises a plurality of parallel rods between which said balls are disposed, with said rods defining an elongated opening and said balls protruding through said opening in position to be engaged by and support a wrist or forearm that extends over said housing.

15. A wrist or forearm support according to claim 14 wherein said housing includes first and second end members, with the opposite ends of said rods being anchored in said end members.

16. A wrist of forearm support according to claim 7 wherein said ball housing comprises a ball-supporting member having oppositely disposed first and second side edges and oppositely disposed third and fourth side edges, said ball-supporting member having a curved portion that defines a channel that extends between said first and second side edges and is characterized by an elongate lengthwise-extending opening, with said balls disposed in said channel and protruding through said opening.

17. A wrist of forearm support according to claim 16 wherein said member is adapted to make a three point contact with said each ball.

18. A wrist or forearm support comprising a ball housing and a plurality of spherical balls, said ball housing comprising means defining a channel in which said balls are captivated in side-by-side relation with each ball being free to contact any adjacent ball, said channel-defining means engaging the outer surfaces of said balls at selected points so as to retain them in said channel and so that they can be rotated in any direction and independently of one another in said channel, said balls protruding from said channel in position to function as a support for a wrist or forearm that extends over the ball housing, whereby multi-directional rotational movement of one or more of said balls can occur in response to movement of a supported wrist or forearm.

* * * * *